US010794375B2

(12) United States Patent
Snyder et al.

(10) Patent No.: US 10,794,375 B2
(45) Date of Patent: Oct. 6, 2020

(54) MINIATURE VACUUM/PRESSURE DIAPHRAGM PUMPS WITH NOISE MITIGATION BOOT

(71) Applicant: Parker-Hannifin Corporation, Cleveland, OH (US)

(72) Inventors: Scott Snyder, Fair Lawn, NJ (US); Leonard Prais, Pompton Lakes, NJ (US); Aman Sharafi, Budd Lake, NJ (US)

(73) Assignee: Parker-Hannifin Corporation, Cleveland, OH (US)

( * ) Notice: Subject to any disclaimer, the term of this patent is extended or adjusted under 35 U.S.C. 154(b) by 187 days.

(21) Appl. No.: 15/567,192

(22) PCT Filed: May 5, 2016

(86) PCT No.: PCT/US2016/030917
§ 371 (c)(1),
(2) Date: Oct. 17, 2017

(87) PCT Pub. No.: WO2016/179360
PCT Pub. Date: Nov. 10, 2016

(65) Prior Publication Data

US 2018/0135615 A1 May 17, 2018

Related U.S. Application Data

(60) Provisional application No. 62/156,962, filed on May 5, 2015.

(51) Int. Cl.
*F04B 39/00* (2006.01)
*F04B 43/02* (2006.01)
(Continued)

(52) U.S. Cl.
CPC ..... *F04B 39/0033* (2013.01); *F04B 39/0027* (2013.01); *F04B 39/0038* (2013.01);
(Continued)

(58) Field of Classification Search
CPC ..... F04B 39/0027; F04B 39/0033; F04B 39/0055; F04B 39/0061; F04B 39/128;
(Continued)

(56) References Cited

U.S. PATENT DOCUMENTS 3,877,842 A * 4/1975 Greene ..... F04B 39/0061 417/312
4,877,378 A 10/1989 Saggers
(Continued)

FOREIGN PATENT DOCUMENTS

DE 20 2006 006042 U1 6/2006
GB 1 354 037 A 6/1974

OTHER PUBLICATIONS

International Search Report and Written Opinion for corresponding Patent Application No. PCT/US2016/030917 dated Jul. 6, 2016.
(Continued)

*Primary Examiner* — Peter J Bertheaud
(74) *Attorney, Agent, or Firm* — Renner, Otto, Boisselle & Sklar, LLP

(57) ABSTRACT

A noise mitigation boot that can be installed on or integrated into a miniature diaphragm pump to reduce the overall noise and improve sound quality during operation. The diaphragm pump includes a housing having first and second ports and an interior chamber, a pumping diaphragm disposed in the interior chamber and dividing the interior chamber into a pumping chamber and a backside chamber, a motor for reciprocating the pumping diaphragm for pumping air into and out of the pumping chamber, and flow passages connecting the pumping chamber to the first and second ports.
(Continued)

The first port is configured for attachment to a flow line and the second port opens to an exterior surface of the housing. The noise mitigation boot has a muffler wall overlying the exterior surface of the housing. The muffler wall has formed therein a passage extending from the second port to the backside chamber for effecting fluid communication between the second port and the backside chamber.

21 Claims, 5 Drawing Sheets

(51) Int. Cl.

| | |
|---|---|
| ***F04B 39/14*** | (2006.01) |
| ***F04B 45/04*** | (2006.01) |
| ***F04B 39/12*** | (2006.01) |
| ***F04B 45/047*** | (2006.01) |

(52) U.S. Cl.
CPC ..... *F04B 39/0055* (2013.01); *F04B 39/0061* (2013.01); *F04B 39/128* (2013.01); *F04B 39/14* (2013.01); *F04B 43/02* (2013.01); *F04B 45/04* (2013.01); *F04B 45/041* (2013.01); *F04B 45/047* (2013.01)

(58) Field of Classification Search
CPC ..... F04B 43/02; F04B 43/023; F04B 43/04; F04B 45/04; F04B 45/041; F04B 45/047; F04B 39/0038
USPC ..... 417/369
See application file for complete search history.

(56) References Cited

U.S. PATENT DOCUMENTS

| | | | | |
|---|---|---|---|---|
| 5,232,353 | A * | 8/1993 | Grant | F04B 7/0038 417/413.1 |
| 5,549,454 | A * | 8/1996 | Earle | F04B 39/0061 417/312 |
| 5,731,556 | A | 3/1998 | Gardner et al. | |
| 6,007,307 | A | 12/1999 | Sonoda | |
| 6,257,842 | B1 * | 7/2001 | Kawasaki | F04B 35/045 181/229 |
| 6,319,212 | B1 | 11/2001 | Müller et al. | |
| 6,485,270 | B2 * | 11/2002 | Wang | F04B 39/0055 181/264 |
| 6,547,749 | B2 * | 4/2003 | Hansen | A61H 9/0078 417/244 |
| 9,358,562 | B2 * | 6/2016 | Ansley | F04B 45/047 |
| 2002/0114711 | A1 | 8/2002 | Wang | |
| 2003/0101959 | A1 * | 6/2003 | Hare | F01M 1/02 123/196 R |
| 2004/0123247 | A1 | 6/2004 | Wachen et al. | |
| 2005/0112004 | A1 * | 5/2005 | Becker | F04B 39/128 417/440 |
| 2006/0034711 | A1 * | 2/2006 | Bergner | F04B 35/045 417/417 |
| 2007/0160485 | A1 | 7/2007 | Huang | |
| 2013/0042753 | A1 | 2/2013 | Becker et al. | |

OTHER PUBLICATIONS

Written Opinion for corresponding Patent Application No. PCT/US2016/030917 dated May 23, 2017.
Written Opinion for corresponding Patent Application No. PCT/US2016/030917 dated Sep. 21, 2017.

* cited by examiner

MINIATURE VACUUM/PRESSURE DIAPHRAGM PUMPS WITH NOISE MITIGATION BOOT

RELATED APPLICATION DATA

This application is a national phase of International Application No. PCT/US2016/030917 filed May 5, 2016 and published in the English language, which claims priority to U.S. Provisional Patent Application No. 62/156,962 filed May 5, 2015, which are hereby incorporation herein by reference.

FIELD OF THE INVENTION

The present invention is generally directed to miniature vacuum/pressure diaphragm pumps and more particularly to such pumps that are used to provide negative pressure wound therapy and/or monitoring, other patient therapy or monitoring.

BACKGROUND OF THE INVENTION

Miniature vacuum diaphragm pumps heretofore have been used in negative pressure wound therapy (NPWT). The pump typically is connected to a semi-occluded or occluded therapeutic member, such as a compressible wound dressing. In other applications, the pump can be configured to supply positive pressure to another therapeutic member, such as an inflatable cuff for various medical therapies.

A problem with known miniature vacuum/pressure diaphragm pumps is that they produce noise at a volume level and/or frequencies that can be annoying and/or disruptive to the patient being treated or monitored. The noise, for instance, may interfere with the patient's sleeping.

SUMMARY OF THE INVENTION

The present invention provides a novel noise mitigation boot that can be installed on or integrated with a miniature diaphragm pump to reduce the overall noise and improve sound quality during operation. The boot, in particular a muffler wall, can reduce pneumatic noise or mechanical noise, or both as is preferred. The boot and more particularly the muffler wall may alter the frequencies of the noise to make the noise less annoying. A noise mitigation boot and miniature diaphragm pump according to the invention may have application to negative pressure wound therapy and/or monitoring, other patient therapy or monitoring, and other pressure and vacuum applications such as agent detection, air monitoring, surgical procedures, pain relief systems and personal safety equipment.

According to one aspect of the invention, a diaphragm pump assembly comprises a diaphragm pump, and a muffler wall disposed on at least one side of the diaphragm pump. The diaphragm pump includes a housing having first and second ports and an interior chamber, a pumping diaphragm disposed in the interior chamber and dividing the interior chamber into a pumping chamber and a backside chamber, a motor for reciprocating the pumping diaphragm for pumping air into and out of the pumping chamber, and flow passages connecting the pumping chamber to the first and second ports. The second port opens to an exterior surface of the housing, and the muffler wall overlies the exterior surface of the housing. The wall has formed therein a passage extending from the second port to the backside chamber for effecting fluid communication between the second port and the backside chamber.

In an embodiment, the muffler wall is part of a noise mitigation boot attached to the diaphragm pump.

In an embodiment, the first port is configured for attachment to a flow line.

The passage preferably follows a serpentine path having back and forth sections.

The passage preferably is formed by a groove in an interior surface of the muffler wall that is in juxtaposition with the exterior surface of the housing.

The backside chamber can open, at an end thereof opposite the pumping diaphragm, to the exterior surface of the housing at an opening, and the groove can have a portion thereof overlapped by the opening.

A plurality of the back and forth sections communicate directly with the backside chamber.

The noise mitigation boot preferably is made of an elastomeric material, in particular butyl or chloroprene rubber, that can have a Shore A durometer hardness of between 40 and 80, preferably between 50 and 70, and more preferably between 55 and 65. The elastomeric material preferably functions as a noise absorber and may also contribute to alteration of the frequencies of the noise generated by the pump.

The muffler wall can be pressed flush with the exterior surface.

The noise mitigation boot can have a plurality of side walls joined to the muffler wall, and the side walls can have interior surfaces pressed flush with respective exterior surfaces of the housing.

The side walls can be stretched around the side walls of the housing for holding the noise mitigation boot on the housing.

The noise mitigation boot can form a seal around the perimeter of the pump but still allows some infiltration of air between the noise mitigation boot and the housing.

At least one exhaust vent can be provided in the noise mitigation boot for allowing the infiltration of air into the interior of the boot for communication with the backside chamber.

The first port can have a tubular extension, preferably provided with a barb, projecting from the housing and though an opening in the noise mitigation boot that is sealed around the tubular extension.

The invention also provide a noise mitigation boot including one or more of the aforesaid features.

The foregoing and other features of the invention are hereinafter described in greater detail with reference to the accompanying drawings.

DETAILED DESCRIPTION

Figure 1:
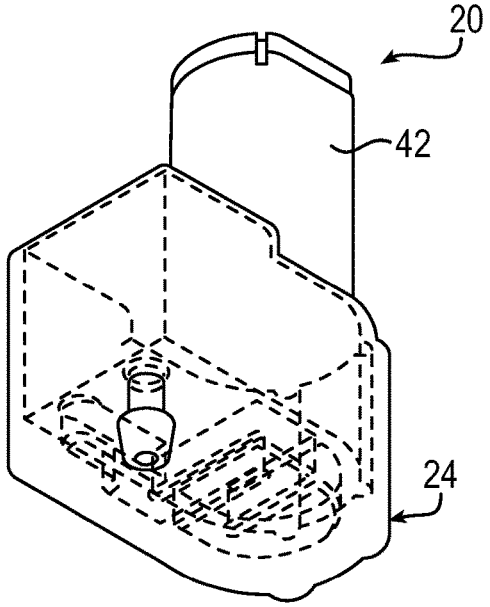
FIG. 1 is a perspective view of an exemplary diaphragm pump assembly according to the invention.
Figure 3:
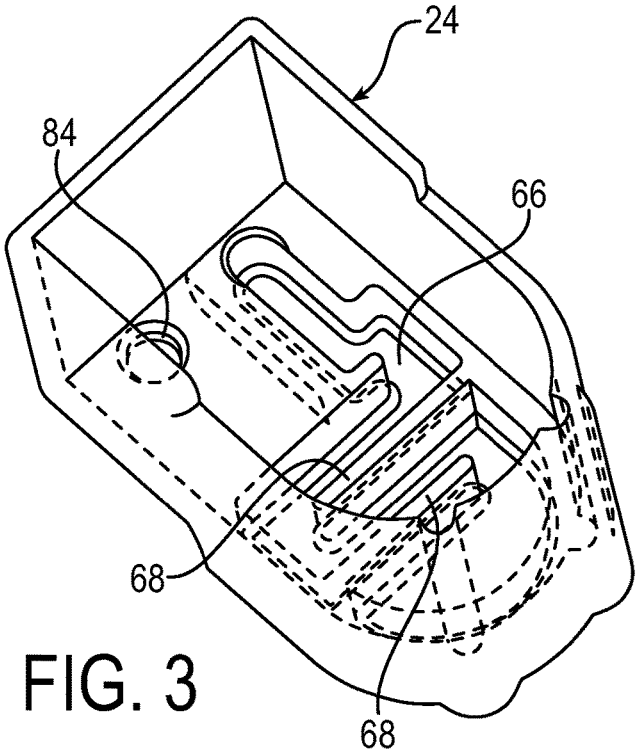
FIG. 3 is an enlarged perspective view showing internal features of the noise mitigation boot.
Figure 4:
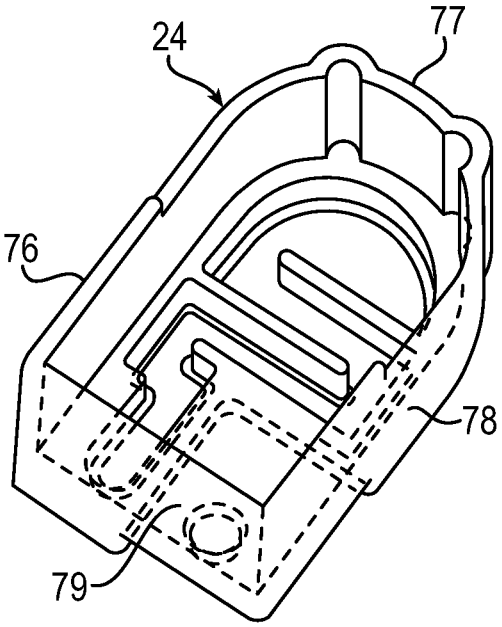
FIG. 4 is another perspective view of the noise mitigation boot.
Figure 5:
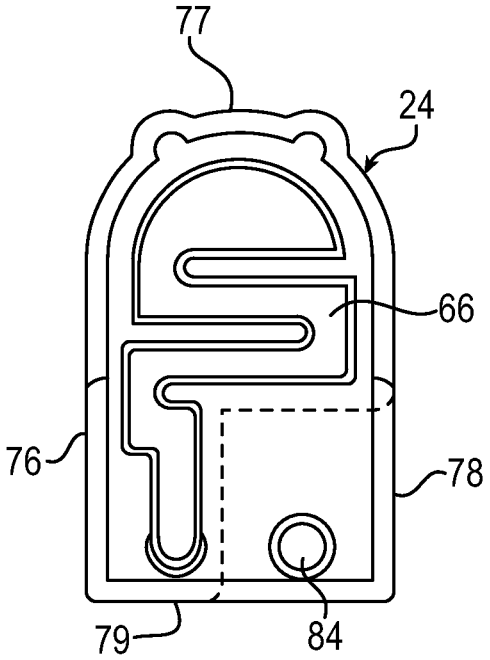
FIG. 5 is a plan view of the noise mitigation boot.
Figure 6:
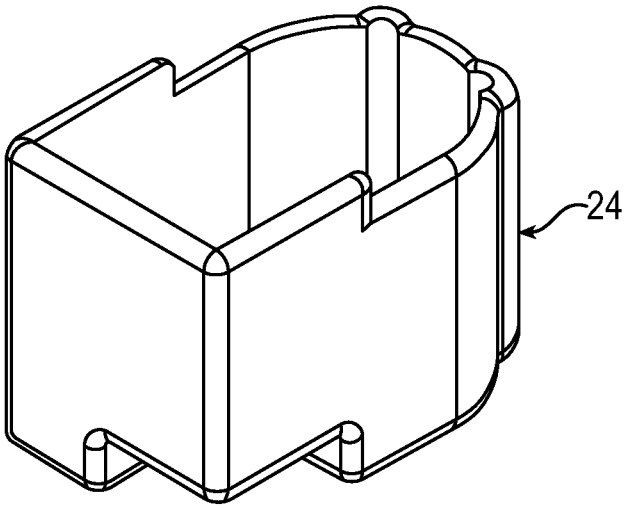
FIG. 6 is another perspective view of the noise mitigation boot.
Figure 7:
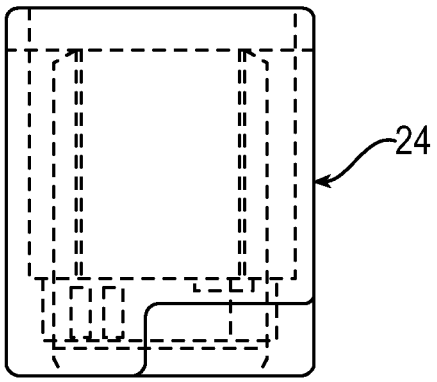
FIG. 7 is an end elevational view of the noise mitigation boot.
Figure 8:
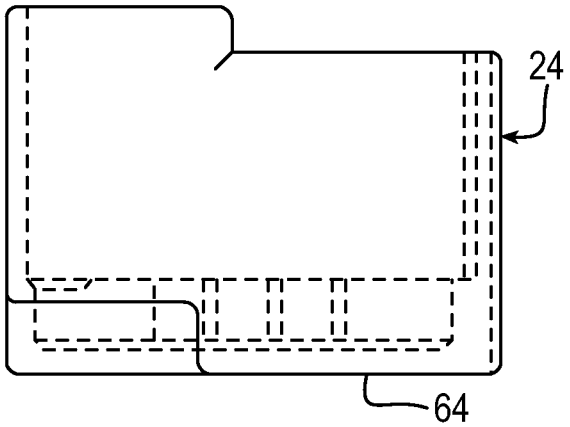
FIG. 8 is a transverse elevational view of the noise mitigation boot.
Figure 9:
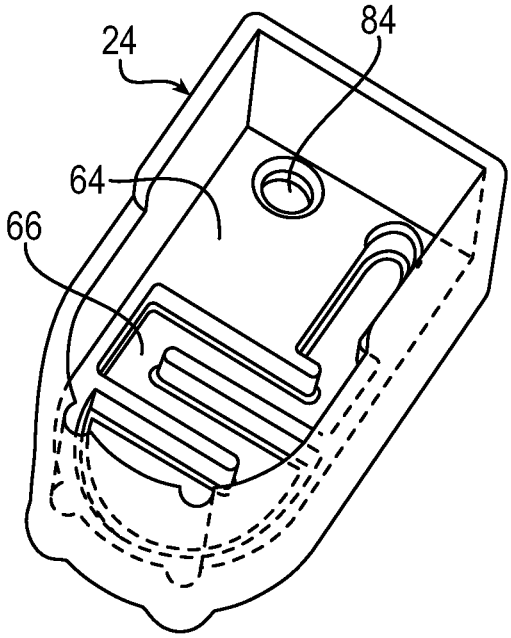
FIG. 9 is still another perspective view of the noise mitigation boot.
Figure 10:
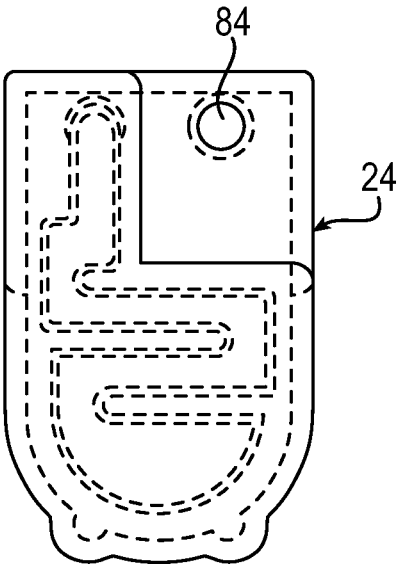
FIG. 10 is a bottom view of the noise mitigation boot.
Figure 11:
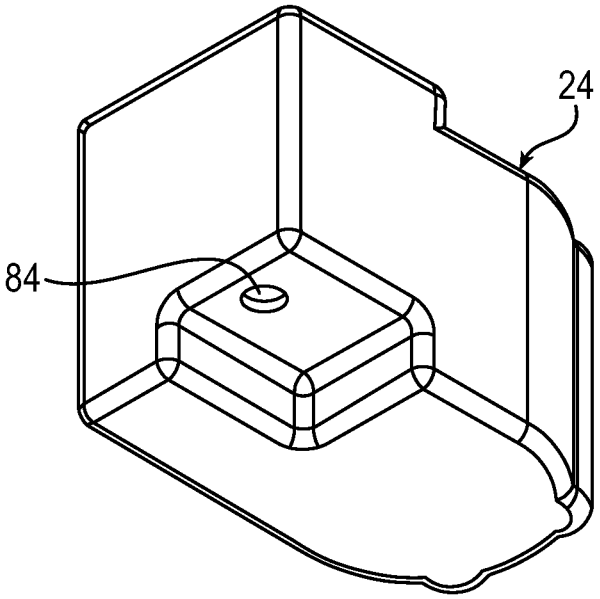
FIG. 11 is a bottom perspective view of the noise mitigation boot.

In the discussion above and to follow, the terms "upper", "lower", "top", "bottom," "end," "inner," "left," "right," "level," "above," "below," "horizontal," "vertical," etc. refer to an exemplary diaphragm pump assembly oriented as shown in FIG. 1. These terms are used to reflect positional relationships with respect to the illustrated orientation and not to limit the diaphragm pump assembly to the illustrated orientation, as it will be appreciated the diaphragm pump assembly can be otherwise oriented.

Figure 2:
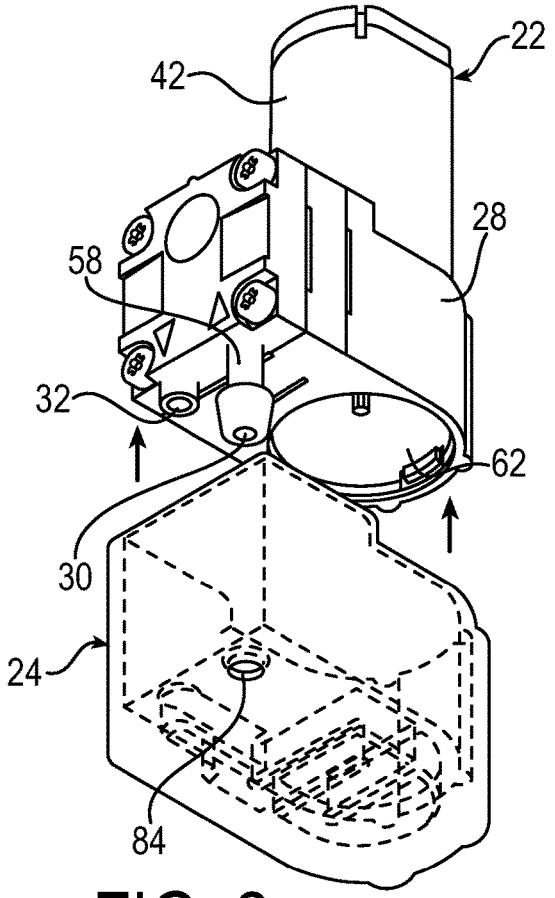
FIG. 2 is an exploded perspective view of the diaphragm pump assembly, showing an exemplary noise mitigation boot removed from a diaphragm pump.

Referring now in detail to FIGS. 1 and 2, the exemplary diaphragm pump assembly is indicated generally by reference numeral 20. The diaphragm pump assembly comprises a diaphragm pump 22 and a noise mitigation boot 24 slipped over the diaphragm pump.

Figure 13:
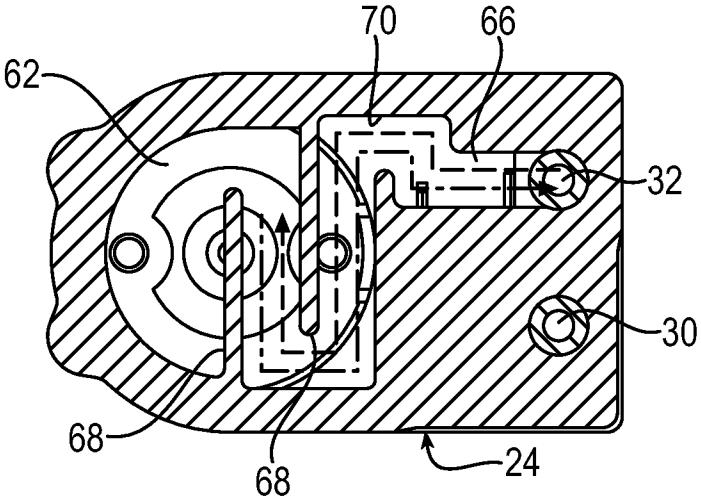
FIG. 13 is a horizontal cross-sectional view of the diaphragm pump assembly.
Figure 12:
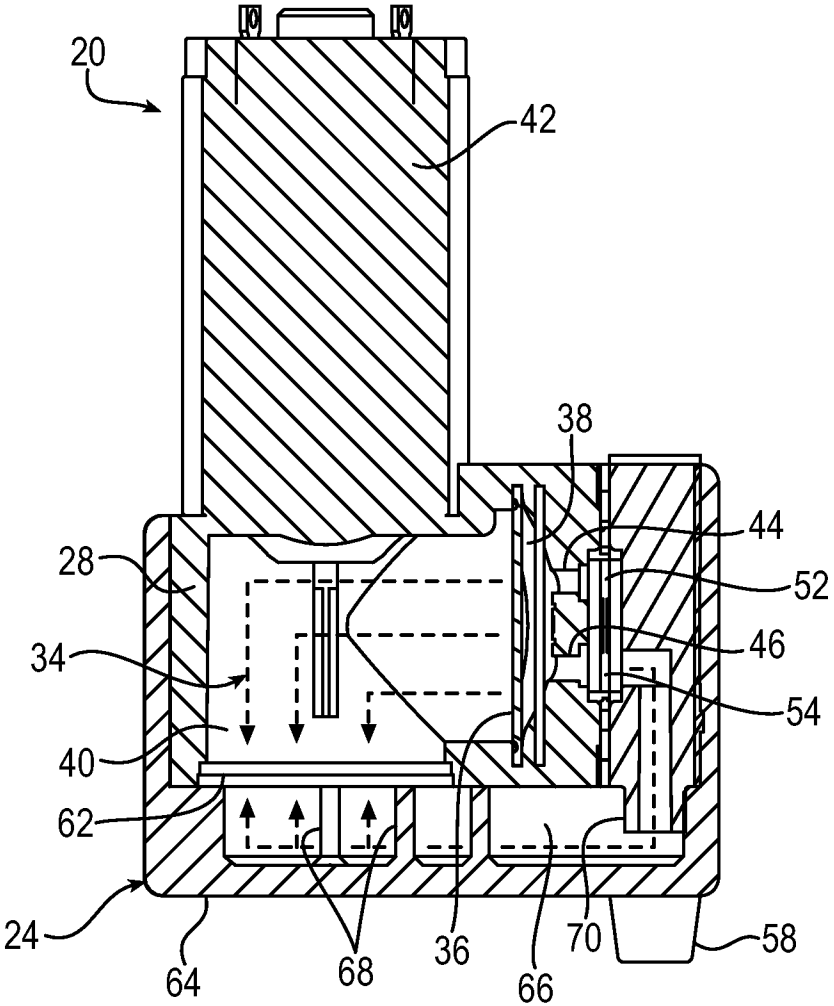
FIG. 12 is a vertical cross-sectional view of the diaphragm pump assembly taken along the line A-A of FIG. 15, with the eccentric and diaphragm plunger removed.
Figure 15:
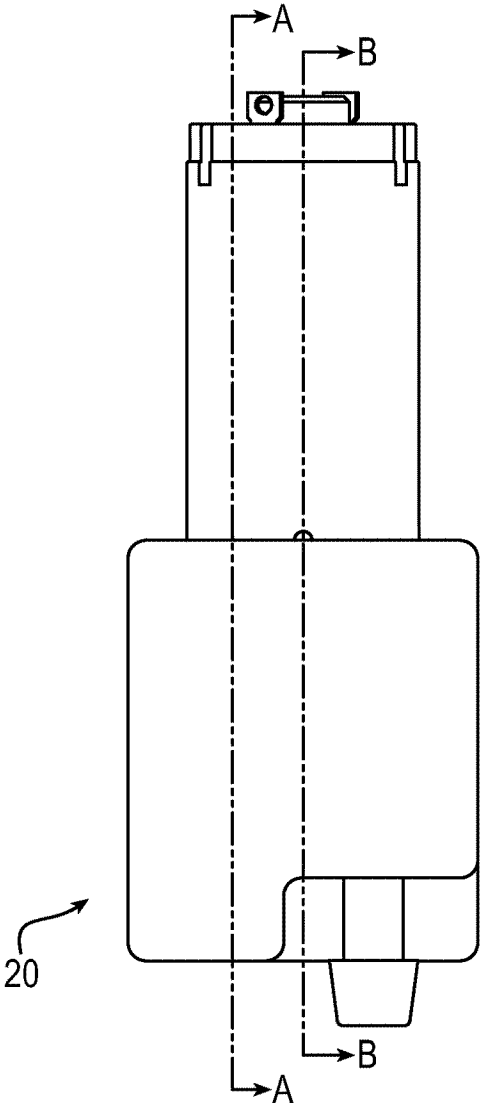
FIG. 15 is a side elevational view of the assembly.

With additional reference to FIGS. 12 and 13, the diaphragm pump 20 includes a housing 28 having first and second ports 30 and 32 and an interior chamber 34. The interior chamber 34 is divided by a pumping diaphragm 36 into a pumping chamber 38 and a backside chamber 40. The diaphragm may be of any suitable type and form, and typically will be formed of an elastomeric material although flexible metal diaphragms also could be used. In the illustrated diaphragm pump, the diaphragm is in the form of a generally planar sheet.

The diaphragm pump 22 further includes a motor 42 for reciprocating the pumping diaphragm 36 for pumping air into and out of the pumping chamber 38, and flow passages 44 and 46 connecting the pumping chamber to the first and second ports 30 and 32. The motor can be of any suitable type such as an electric rotary motor, a linear actuator such as a solenoid, etc.

In the illustrated embodiment, an electric rotary motor is used. The motor can be powered to drive an eccentric 48 that reciprocates a plunger 50 back and forth for reciprocating the pumping diaphragm back and forth. This motion in one direction (intake/expansion stroke) increases the pumping chamber volume for drawing air into the pumping chamber via one of the flow passages. Motion in the reverse direction (outflow/compression stroke) for forcing the air out of the pumping chamber via the other of the flow passages. The flow passages 44 and 46 may include respective check valves 52 and 54 so that air can flow through the passages only in one direction. In alternative arrangement, one or both check valves may be provided in respective external flow lines connected to the ports.

The diaphragm pump 20 may be configured for use as either a vacuum pump or a pressure pump. In the illustrated embodiment, the diaphragm pump is configured for use as a vacuum pump. To this end, first (or intake) port 30 is configured for attachment to a vacuum flow line and the second (or exhaust) port 32 opens to an exterior surface of the housing 28, such as the bottom surface 56 as best shown in FIGS. 2 and 12. In particular, the first port is provided with a tubular projection 58 that preferably is provided with at least one barb 60 for holding to the tubular projection a flow line that can be pushed onto the tubular projection. If used as a pressure pump, the exhaust port may be attached to a pressure flow line, and the intake port may draw in a fluid to be pumped.

The check valves 50 and 54 are arranged such that during the intake stroke of the diaphragm 36, air is drawn in through the intake port 30 and during the outflow stroke the air in the expanded chamber is directed to the exhaust port 32. For use as a pressure pump, the check valves may be oppositely arranged.

As above mentioned, the second port 32 opens to an exterior surface of the pump housing, such as the bottom surface 56 as best shown in FIGS. 2 and 12. The backside chamber 38 also opens to an exterior surface of the pump housing, preferably at the same exterior surface 56 of the pump housing at an opening 62.

The noise mitigation boot 24 has a muffler wall 64 overlying the exterior surface 56 of the housing 28. The muffler wall has formed therein a passage 66 extending from the second port 32 to the backside chamber 40 for effecting fluid communication between the second port and the backside chamber. The passage 66 preferably forms a convoluted path, that may have back and forth sections separated by baffle walls 68 to form a serpentine path. The passage may have a minimum cross-sectional area equal or greater than the cross-sectional area of the second port 32, although smaller cross-sectional areas are possible.

As shown, the passage 66 preferably is formed by a groove 70 in an interior surface of the muffler wall 64 that is in juxtaposition with the exterior surface 56 of the housing. One end of the groove communicates with the second port 32 and the other end communicates with the backside chamber 40. In particular, the groove at one end overlaps the second port and at the other end overlaps the backside chamber opening. Preferably, a plurality of the back and forth sections of the serpentine groove communicate directly with the backside chamber.

Hence, the muffler wall 64 and more generally the noise mitigation boot 24 provides pneumatic communication between the second port 32 and the backside chamber behind the pumping diaphragm. This is shown by the dashed lines in FIGS. 12 and 13. This functions to reduce pneumatic noise. In particular, the exhaust air assists the compression stroke of the pump and is essentially idle during the expansion stroke. The pneumatic communication isolates pneumatic pumping noise with little performance impact. When the pump is used as a pressure pump, the reverse is true with air pulses being substantially cancelled.

The noise mitigation boot 24 preferably is made of an elastomeric material, in particular butyl or chloroprene rubber, that can have a Shore A durometer hardness of between 40 and 80, preferably between 50 and 70, and more preferably between 55 and 65. The muffler wall 64 preferably is pressed flush with the exterior surface such that the exterior surface closes the topside of the serpentine groove.

Figure 14:
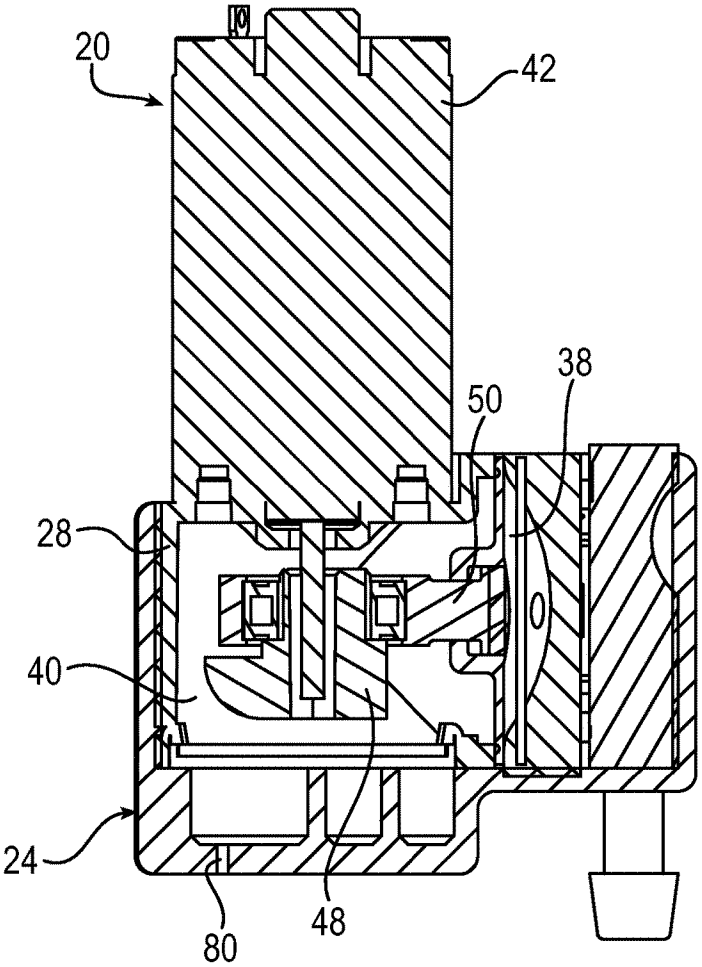
FIG. 14 is a vertical cross-sectional view taken along the line B-B of FIG. 15, and showing the eccentric and diaphragm plunger.

As best shown in FIGS. 3-11, the noise mitigation boot 24 can have a plurality of side walls 76-79 joined to the muffler wall. The side walls can have interior surfaces pressed flush with respective exterior surfaces of the housing 22. The side walls preferably are stretched around the side walls of the housing for holding the noise mitigation boot on the housing. The noise mitigation boot can form a seal around the perimeter of the pump, although some infiltration of air between the noise mitigation boot and the housing is provided for efficient operation of the pump. At least one exhaust vent 80 (FIG. 14) can be provided in the noise mitigation boot for allowing the infiltration of air into the interior of the boot for communication with the backside chamber. Otherwise, the boot preferably fits tightly around the pump housing for aiding pneumatic communication between the second port and the backside chamber and to help reduce mechanical noise transmitted through the housing that typically will be made of plastic.

Generally, the diaphragm pump, with the noise mitigation boot installed, may experience a reduction in flow from 0% to 30%, or from 1% to 20%, or more typically 2% to 10%. The pump may also experience an increase in power consumption from 0% to 30%, or from 1% to 20%, and more typically from 2% to 10%.

The noise mitigation boot 24 preferably has an opening 84 through which the tubular port extension 58 extends. The noise mitigation boot may be sealed around the tubular extension at the opening in the boot.

Although the illustrated boot has other walls in addition to the muffler wall 64 for enabling attachment of the boot to the pump, the boot may consist of only the muffler wall that may be integrated into the pump assembly in any suitable manner.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A diaphragm pump assembly comprising:

a diaphragm pump; and a muffler wall disposed on at least one side of the diaphragm pump;

wherein the diaphragm pump includes a housing having first and second ports and an interior chamber, a pumping diaphragm disposed in the interior chamber and dividing the interior chamber into a pumping chamber and a backside chamber, a motor for reciprocating the pumping diaphragm for drawing air into and pumping air out of the pumping chamber, and flow passages connecting the pumping chamber to the first and second ports, wherein the second port opens to an exterior surface of the housing; and wherein the muffler wall overlies the exterior surface of the housing, the wall having formed therein a passage extending from the second port to the backside chamber for effecting fluid communication between the second port and the backside chamber, and wherein the muffler wall is part of a noise mitigation boot attached to the diaphragm pump.

2. The diaphragm pump assembly of claim 1, wherein the first port is configured for attachment to a flow line.

3. A diaphragm pump assembly comprising:

a diaphragm pump; and a muffler wall disposed on at least one side of the diaphragm pump;

wherein the diaphragm pump includes a housing having first and second ports and an interior chamber, a pumping diaphragm disposed in the interior chamber and dividing the interior chamber into a pumping chamber and a backside chamber, a motor for reciprocating the pumping diaphragm for drawing air into and pumping air out of the pumping chamber, and flow passages connecting the pumping chamber to the first and second ports, wherein the second port opens to an exterior surface of the housing; and wherein the muffler wall overlies the exterior surface of the housing, the wall having formed therein a passage extending from the second port to the backside chamber for effecting fluid communication between the second port and the backside chamber, and wherein the passage follows a serpentine path.

4. The diaphragm pump assembly of claim 1, wherein the passage is formed by a groove in an interior surface of the muffler wall that is in juxtaposition with the exterior surface of the housing.

5. The diaphragm pump assembly of claim 4, wherein the groove has a serpentine shape including back and forth sections.

6. The diaphragm pump assembly of claim 4, wherein the backside chamber opens, at an end thereof opposite the pumping diaphragm, to the exterior surface of the housing at an opening, and the groove has a portion thereof overlapped by the opening.

7. The diaphragm pump assembly of claim 6, wherein the groove has a serpentine shape including back and forth sections.

8. The diaphragm pump assembly of claim 7, wherein a plurality of the back and forth sections communicate directly with the backside chamber.

9. The diaphragm pump assembly of claim 1, wherein the noise mitigation boot is made of an elastomeric material.

10. The diaphragm pump assembly of claim 9, wherein the elastomeric material has a Shore A durometer hardness of between 40 and 80.

11. The diaphragm pump assembly of claim 1, wherein the muffler wall is pressed flush with the exterior surface.

12. The diaphragm pump assembly of claim 1, wherein the noise mitigation boot has a plurality of side walls joined to the muffler wall, and the side walls have interior surfaces pressed flush with respective exterior surfaces of the housing.

13. The diaphragm pump assembly of claim 12, wherein the side walls are stretched around the side walls of the housing for holding the noise mitigation boot on the housing.

14. The diaphragm pump assembly of claim 12, wherein the noise mitigation boot forms a seal around the perimeter of the pump but still allows some infiltration of air between the noise mitigation boot and the housing.

15. The diaphragm pump assembly of claim 14, wherein at least one exhaust vent is provided in the noise mitigation boot for allowing the infiltration of air into the interior of the boot for communication with the backside chamber.

16. The diaphragm pump assembly of claim 1, wherein the first port has a tubular extension projecting from the housing and though an opening in the noise mitigation boot that is sealed around the tubular extension.

17. A noise mitigation boot configured to be slipped over a diaphragm pump for mitigating noise generated by the diaphragm pump, the diaphragm pump including a housing having first and second ports and an interior chamber, a pumping diaphragm disposed in the interior chamber and dividing the interior chamber into a pumping chamber and a backside chamber, a motor for reciprocating the pumping diaphragm for drawing air into and pumping air out of the pumping chamber, and flow passages connecting the pumping chamber to the first and second ports, with the first port being configured for attachment to a flow line and the second port opening to an exterior surface of the housing, the noise mitigation boot having a muffler wall for overlying the exterior surface of the housing, the muffler wall having formed therein a passage extending from a region of the boot that communicates with the second port to the backside chamber for effecting fluid communication between the second port and the backside chamber.

18. The noise mitigation boot of claim 17, wherein the passage is formed by a groove in an interior surface of the muffler wall that is in juxtaposition with the exterior surface of the housing.

19. The noise mitigation boot of claim 18, wherein the groove has a serpentine shape including back and forth sections.

20. The noise mitigation boot of claim 17, wherein the noise mitigation boot is made of an elastomeric material that has a Shore A durometer hardness of between 40 and 80.

21. The noise mitigation boot of claim 20, comprising a plurality of side walls joined to the muffler wall, and the side walls have interior surfaces configured to be pressed flush with respective exterior surfaces of the housing when the noise mitigation boot is stretched over the housing of the diaphragm pump.

* * * * *